US005186370A

United States Patent [19]

Ricketts

[11] Patent Number: 5,186,370

[45] Date of Patent: Feb. 16, 1993

[54] CONTAINER RESEALING METHOD AND APPARATUS

[76] Inventor: Robert M. Ricketts, 5054 Odins Way, Marietta, Ga. 30068

[21] Appl. No.: 659,848

[22] Filed: Feb. 22, 1991

[51] Int. Cl.[5] ..... B65D 47/00

[52] U.S. Cl. ..... 222/545; 222/551; 222/562

[58] Field of Search ..... 222/83, 89, 91, 81, 222/80, 545, 562, 551, 549, 402.13; 220/234–236, 237, 238, 288, 303, 304, 308, 319, 85 SP; 215/247, 274, 276, 280, 283, 307, 311, 321, 329, 341, 346

[56] References Cited

U.S. PATENT DOCUMENTS

| | | | |
|---|---|---|---|
| 2,091,737 | 8/1937 | Longway | 222/89 X |
| 2,373,373 | 4/1945 | Berg | 222/83 |
| 2,721,003 | 10/1955 | Linton | 222/83 |
| 4,180,178 | 12/1979 | Turner | 220/281 |
| 4,598,835 | 7/1986 | Brownbill | 215/307 |
| 4,709,825 | 12/1987 | Mumford | 215/318 |
| 4,856,667 | 8/1989 | Thompson | 215/318 |

*Primary Examiner*—David H. Bollinger
*Attorney, Agent, or Firm*—Hopkins & Thomas

[57] ABSTRACT

A device for closing and resealing an opened container such as a beverage can comprises a threaded cap (13) and a corresponding threaded skirt (22) adapted to be threaded together and apart. The skirt has an upper surface that moves toward and away from a cam surface formed in the underside of the cap as the cap and skirt are threaded together and apart. A compression ring (27) adapted to be compressed and expanded in diameter is captured between the upper surface of the skirt and the cam surface of the cap. As the cap is threaded progressively onto the skirt, the compression ring is engaged by and rides along the cam surface and is thus progressively compressed in diameter. An annular sealing gasket (21) depends from the underside of the cap (13) and is sized to seat about the peripheral portion of the end of the container as the cap moves downwardly toward the top of the container. In use, the assembly is placed over the top portion of a container and the cap is threaded onto the skirt until the compression ring is compressed into gripping engagement with the container at the bottom of the chime thereof whereupon the cap is threaded further until its gasket engages and seats about the periphery of the can end, thus sealing off the can.

6 Claims, 4 Drawing Sheets

CONTAINER RESEALING METHOD AND APPARATUS

TECHNICAL FIELD

This invention relates to containers such as beverage cans and the like and particularly to methods and devices for closing and resealing such containers after opening.

BACKGROUND OF THE INVENTION

Metal containers have long enjoyed widespread acceptance and extensive use in the packaging industry for containing a wide variety of products ranging from food to automotive chemicals. Such containers have proven particularly suitable for containing volatile and carbonated liquids because of their ability to withstand high internal pressures while resisting migration of gas molecules through the container walls and into the atmosphere. Perhaps the best known and possibly most extensive use of such metal containers is the common aluminum beverage can used to contain and dispense carbonated soft drinks and beer.

While aluminum beverage cans have proven highly successful since their introduction and have undergone many improvements such as the easy-opening pop-top, they nevertheless have long been plagued with a persistent and heretofore unsuccessfully addressed problem inherent in their respective designs. Namely, once opened, the common beverage can is virtually impossible to reseal effectively against spoilage, contamination, and decarbonation of its contents. As a result, the entire beverage must either be consumed completely upon opening the can or discarded as unusable waste. The same problem plagues containers for other volatile liquids such as freon refrigerant often used to recharge automotive air conditioning systems.

As a consequence of the difficulty in resealing aluminum beverage and other cans, such cans have long been limited to single serving or single use sizes and metal container manufacturers have generally been unable to compete with makers of plastic and glass bottles in the growing and ever more lucrative markets for larger multiple serving or multiple use sized containers.

Prior attempts to provide means for resealing an opened aluminum can have included separate stoppers, purchased as accessories, that snap into the can opening in attempt to seal the can. While such stoppers represent a small step in the right direction, they nevertheless generally tend to be inconvenient and ineffective since they are easily lost and usually do not conform well to or seal effectively the can opening.

Other examples of devices for resealing opened containers are disclosed in Summers U.S. Pat. No. 3,610,306, Turner U.S. Pat. No. 4,180,178, and Thompson U.S. Pat. No. 4,856,667. While these devices can be somewhat useful for resealing non-pressurized containers, they generally are not intended nor are they suitable for resealing against internal pressures that can be generated within a partially filled carbonated beverage or volatile liquid container and therefore fail to address the problems discussed above.

Thus, a continuing and heretofore unaddressed need exists for an inexpensive and simple-to-use method and apparatus for closing and resealing effectively an opened beverage can or indeed any metal container of pressurized liquids and gasses. The present invention is such a method and apparatus.

SUMMARY OF THE INVENTION

The present invention in one preferred embodiment comprises a convenient and reliable method and apparatus for closing and resealing an opened container such as a carbonated beverage can. The apparatus includes an internally threaded cap adapted to fit over the top of the can, an externally threaded skirt sized to fit about the upper portion of the can and adapted to receive the threaded cap, and a compression ring captured between the top of the skirt and a contoured cam surface formed around the periphery of the underside of the cap. The cam surface confronts and moves toward the top of the skirt to engage and diametrically compress the compression ring into firm gripping engagement with the can as the cap is progressively threaded onto the skirt whereafter the skirt top bears against the ring to lock the skirt on the can.

The underside surface of the cap is also formed with a depending annular projection sized to extend into the peripheral depression that bounds the can end adjacent the chime thereof as the cap advances further onto the skirt. The lower end of the projection is provided with an annular gasket adapted to engage and seat within the peripheral depression as the cap is threaded further onto the skirt and thus downwardly toward the top of the can.

In operation, the cap and skirt are threaded apart a sufficient distance to allow the compression ring to expand to a diameter slightly larger than that of the upper peripheral chime of the can. The assembly may then be placed over the top of an opened can whereupon the cap is threaded progressively onto the skirt. As the cap and skirt are threaded together, the compression ring is engaged and compressed in diameter by the cam surface in the cap until the ring wedges firmly against the chime to lock the skirt into position on the can. Further threading, then, moves the cap downwardly onto the can until its annular gasket engages and seats within the peripheral annular depression of the can end to seal against escape of pressure from the can. For reopening, the cap is simply unthreaded from the skirt until the assembly can be removed from the can for dispensing its contents in the usual way.

It is therefore an object of this invention to provide a simple, reliable, and economical method and apparatus for resealing an opened container.

Another object of the invention is to provide a beverage can capping and resealing device that can be used over and over to reseal beverage cans against decarbonation and spoilage of their contents.

A further object of the invention is to provide an apparatus for reliably resealing containers of highly volatile high pressure liquids such as freon refrigerant.

These and many other objects, features, and advantages of the invention will become more apparent upon review of the following detailed description taken in conjunction with the accompanying drawings.

DETAILED DESCRIPTION OF THE PREFERRED EMBODIMENTS

Figure 1:
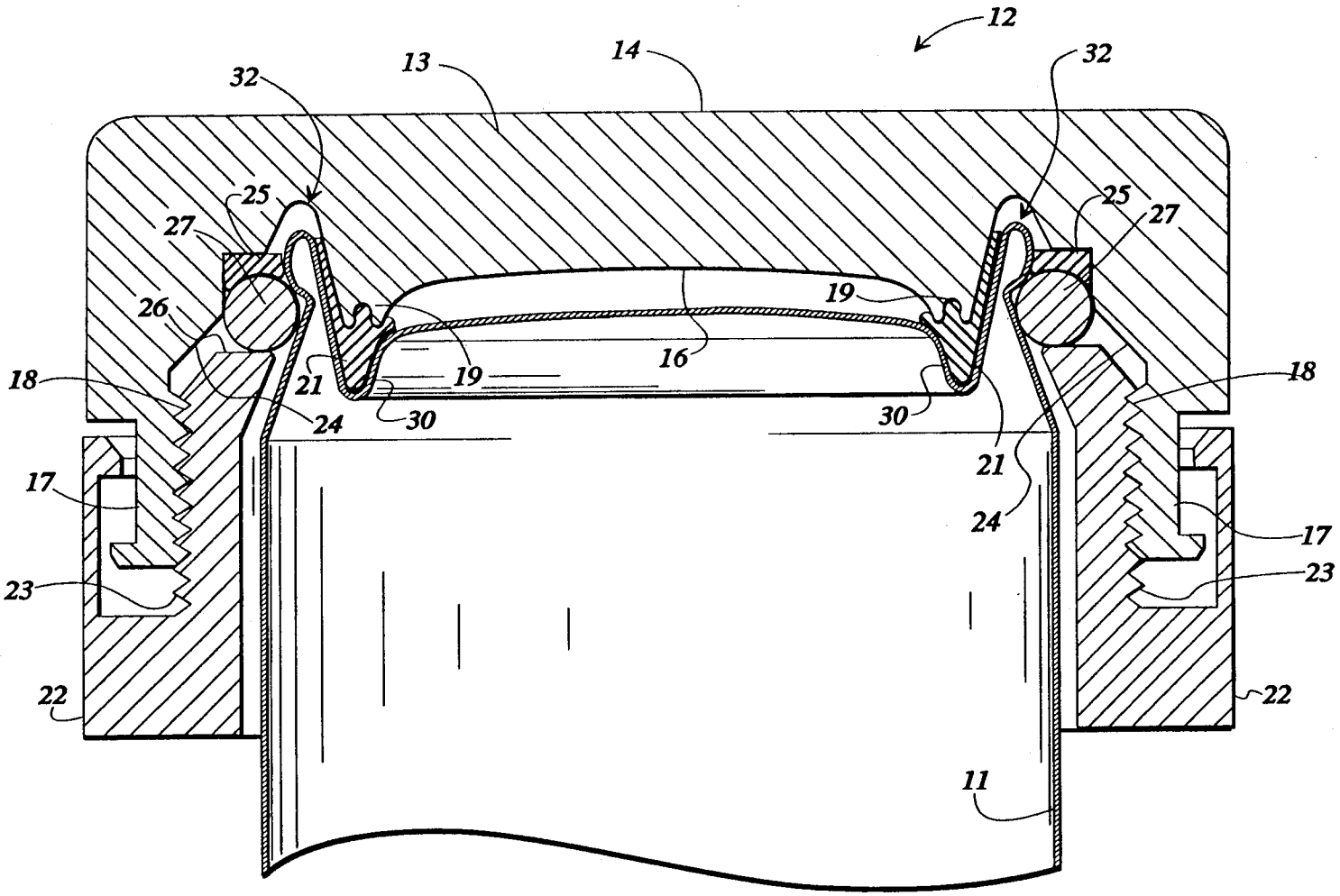
FIG. 1 is a side elevational sectional view of a container resealing apparatus that embodies principals of the invention in one preferred form.
Figure 2:
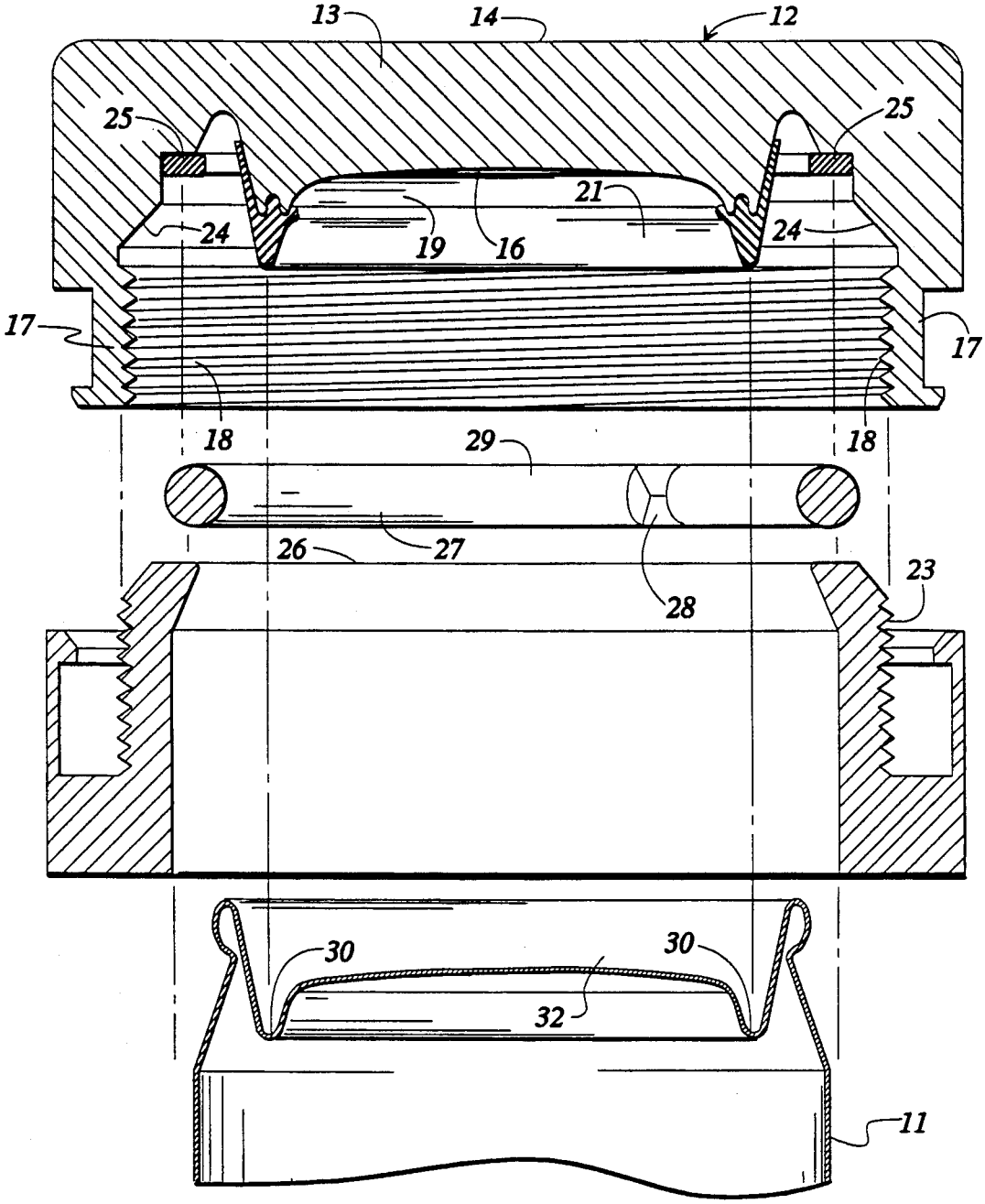
FIG. 2 is an exploded sectional view of the apparatus of FIG. 1.

Referring now in more detail to the drawings, in which like numerals refer to like parts throughout the several views, FIGS. 1 and 2 illustrate a container closure and resealing apparatus that embodies principles of the present invention in a preferred form for closing and resealing a common beverage can 11. The apparatus 12 is seen to comprise a generally cylindrical or disk shaped cap 13 having an upper surface 14, an underside surface 16, and a depending peripheral rim 17 formed with internal threads 18.

A generally cylindrical skirt 22 is sized to be received onto and extend about the upper portion of the can 11 and is formed with a set of exterior threads 23 configured for operative threading engagement with the threads 18 of the cap rim 17 as shown.

The underside surface 16 of the cap 13 is formed with a contoured cam surface 24 that extends about the interior periphery of the cap. The cam surface 24 is formed with an inwardly sloped lower portion and a substantially vertical upper portion. An annular rubber pad 25 is disposed about the upper portion of the cam surface 24 for purposes detailed below. The skirt 22 has an upper surface 26 that generally confronts and moves toward the cam surface 24 as the cap 13 and skirt 22 are threaded progressively together.

Figure 3:
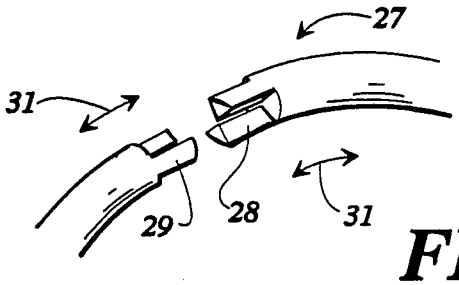
FIG. 3 depicts a portion of the compression ring of the invention illustrating a preferred configuration for providing a ring that can be compressed and expanded in diameter.

A compression ring 27 is disposed and captured within the space between the upper surface 26 of the skirt 22 and the cam surface 24 of the cap 13. As best seen in FIG. 3, the compression ring 27 is preferably split and formed with complementary end portions 28 and 29 that cooperate to allow the ring 27 to be compressed and expanded in diameter as indicated by the arrows 31. In this regard, the ring 27 is preferably spring biased to a diametrically expanded configuration such that it fits snugly within the space defined by the skirt upper surface 26 and cap cam surface 24. As the cap 13 is threaded progressively onto the skirt 22, the ring 27 is engaged by and rides up the cam surface 24 thereby compressing the ring to progressively smaller diameters.

The underside surface 16 of the cap 13 is formed with a depending annular projection 19 that is inwardly concentric with respect to the cam surface 24 and bears at its lower end portion a gasket 21. The projection 19 is sized to extend into the annular depression 31 formed in the can end just inside the peripheral chime 32 thereof as the cap moves downwardly toward the top of the can 11. The gasket 21 is preferably formed of rubber or other suitable material adapted to engage and seat firmly within the bottom of depression 30 upon downward movement of the cap 13 onto the can 11. Further, the gasket 21 preferably extends partially up the exterior surface of the projection 19 (FIG. 2) to engage and seat against the side of the can's peripheral chime for added sealing capacity.

In use for closing and resealing an opened can, the cap 13 and skirt 22 are threaded apart a sufficient distance to permit the compression ring 27 to ride down the cam surface 24 and thus expand to a diameter just larger than that of the chime 32. The apparatus 12 may then be slipped over the top of the can 11 with its skirt 22 surrounding the upper portion of the can and its cap 13 spanning and covering the end of the can. The cap 13 is then threaded progressively onto the skirt 22 causing the compression ring 27 to be engaged by and ride up the lower sloped portion of the cam surface 24 to compress the ring diametrically into gripping engagement with the lower lip of the chime 32. When the ring has been compressed sufficiently, it moves onto the vertical upper portion of the cam surface, thus substantially locking the ring into place. At this point, the pad 25 is engaged and compressed by the ring 27 and serves to urge the ring back down onto the sloped portion of the cam surface upon subsequent removal of the cap.

The ring 27 thus becomes wedged between the chime 32 and the upper surface 26 of the skirt 22 to resist upward movement of the skirt 22 and thus lock the skirt in position on the can. Further threading of the cap 13 onto the skirt, then, draws the cap downwardly onto the can until the gasket 21 seats firmly within the depression 30 thus sealing off the can 11 against decarbonation and spoilage of its contents. The resealed can may then be put aside for future use, whereupon the cap 13 is simply unthreaded from the skirt 22 permitting the ring 27 to expand along the lower portion of the cam surface 24 such that the entire apparatus may be lifted off the can for dispensing its contents.

Figure 4:
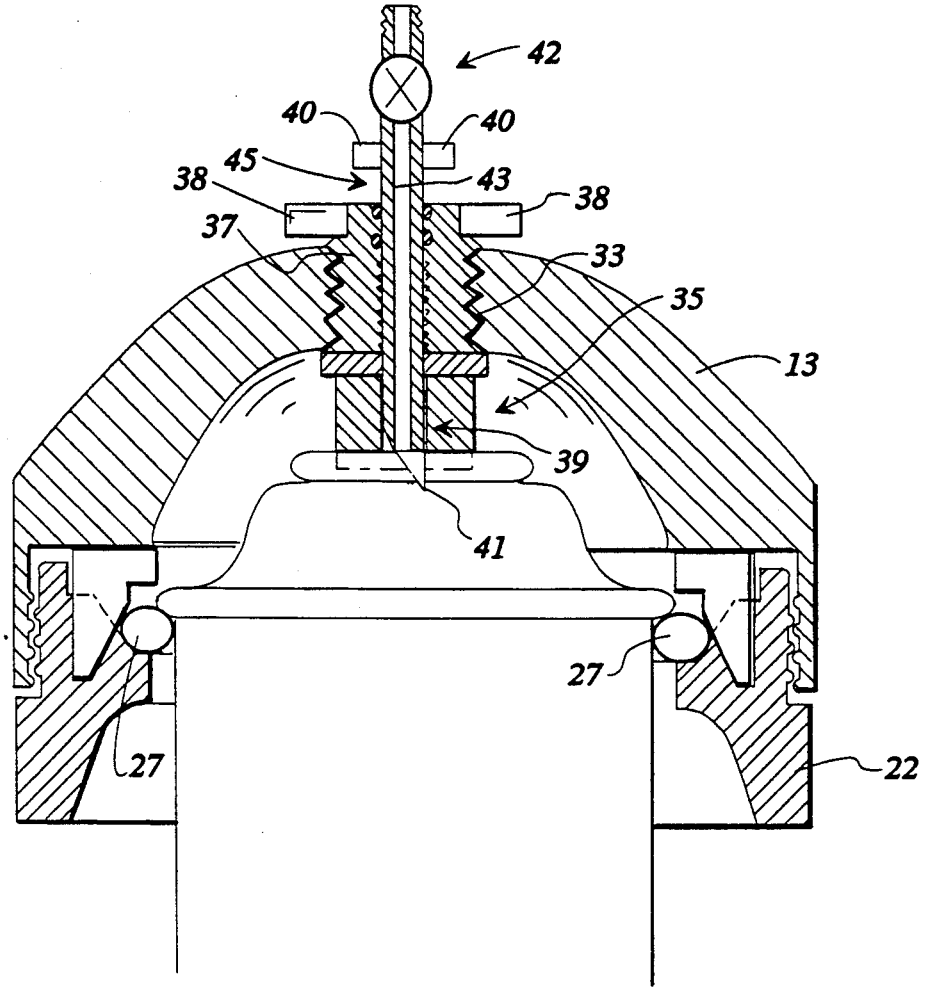
FIG. 4 is a side elevational sectional view of an alternate embodiment of the invention that includes means for puncturing and extracting contents from a container with the closure assembly in place.

FIG. 4 illustrates a second embodiment of the present invention that includes means for piercing a container for dispensing the contents thereof after the resealing apparatus has been secured firmly to the can. As with the embodiment of FIG. 1, the apparatus comprises a cap 13, a skirt 22, and a compression ring 27 that is compressed into gripping engagement with the container chime upon initial threading of the cap onto the skirt to lock the apparatus in place on the can. The cap 13 is formed with a central threaded bore 33 extending through the cap 13 and communicating with the underside thereof.

A threaded plug 37 is configured to be advanced into and out of the bore 33 and includes a pair of opposed outwardly extending wings 38 adapted to facilitate manual rotation of the plug 37 for advancing it through the bore 33.

The plug 37 is formed with a central threaded bore through which is threaded an axially extending tube 45 having a downwardly extending lower portion 39 and an upwardly extending upper portion 42. A central passage 43 extends and communicates through the tube 45. The lower end 39 of the tube 45 extends through the bottom of the plug 37 and through an annular collar 35 that is secured to or formed with the plug 37. The lower peripheral portion of the collar 35 preferably bears an annular gasket sized to engage and seat against the top of the can as the plug 37 is threaded into the bore 33. A pair of radially extending wings 40 are formed on the upper portion 42 of the tube 45 to facilitate manual threading of the tube into and out of the threaded central bore of the plug 37. A pair of O-rings 36 can be positioned to seal against escape of pressurized gas along the interface between the tube 45 and the wall of the bore in the plug 37.

In operation, the apparatus of FIG. 4 is secured to the can and the plug 37 is threaded through the cap 13 until its lower peripheral edge engages and seats against the top of the can. The tube 45 is then threaded into the central bore of the plug 37 with the O-rings 36 tightly embracing the tube shaft to prevent leakage between the wall of the plug central bore and the tube 45. The lower end 39 of tube 45 is formed with a sharpened tip 41 adapted to pierce the top of the container for access to the contents thereof as the tube 45 is threaded into the central bore of the plug 37.

A valve 44 is expediently provided in the upper portion 42 of the tube with the valve being adapted to open and close communication through the tube. The extreme upper end of the tube upper portion 42 can be threaded or otherwise formed to receive a hose or the like for delivering the contents of the container to a remote location for use.

In use, the embodiment of FIG. 4 is placed over the top of a container and secured thereto by threading the cap 13 securely onto the skirt 22. The plug 37 is then threaded through the cap central bore 33 until its gasketed lower peripheral edge seats and seals against the top of the can. With the cap thus secured to and sealing off the top of the can, the tube 45 can be threadingly advanced progressively into the central bore of the plug 37 by means of the wings 40 until the tip 41 of the tube 45 pierces the top of the container 11 to access its contents. In this regard, the O-rings 26 function to prevent the escape of pressurized gasses within the can through the slight space between the tube 45 and the walls of the central bore of the plug 37.

With the container pierced, the tube 45 can be threaded completely into the plug 37 until its wings 40 abut the top of the plug thereby extending the tip 39 of the tube into the can. The upper end 42 of the tube 45 can then be connected to a common dispensing hose and the valve 44 opened to dispense the contents of the can through the hose. The embodiment of FIG. 4 is particularly useful for selectively dispensing highly volatile high pressure materials such as freon refrigerant. If only a portion of such refrigerant is dispensed, for example, the valve 44 can be closed whereupon the seated gasket of the annular collar 35 and the O-rings maintain the pressure within the container until future use requirements.

Figure 5:
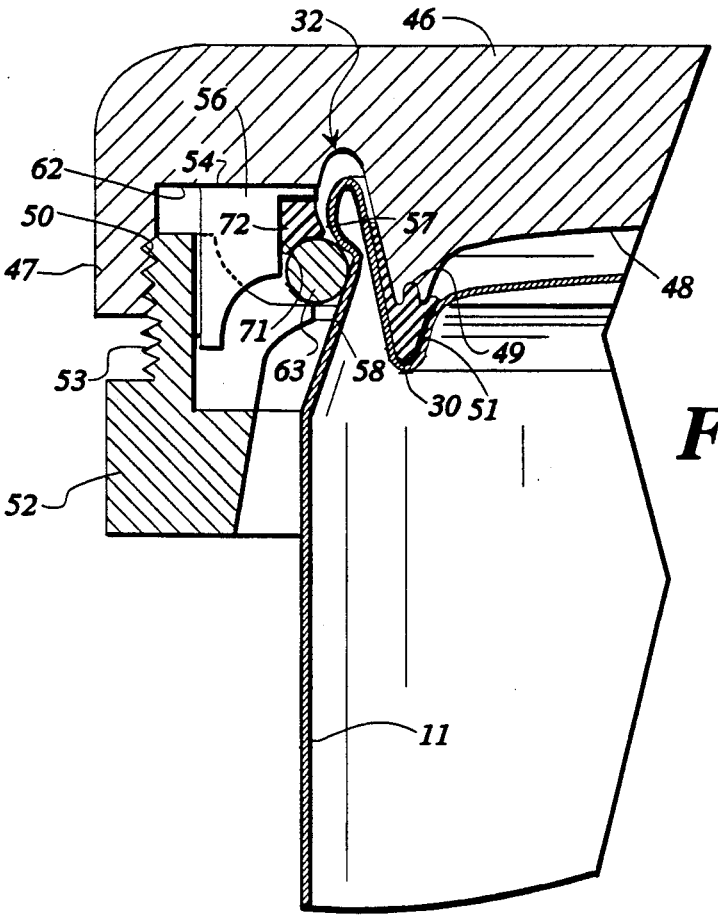
FIG. 5 is a partial elevational sectional view of a third embodiment of the invention.
Figure 6:
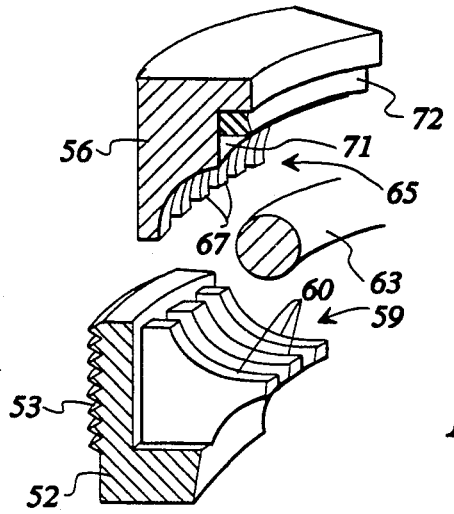
FIG. 6 is a partial perspective view of a portion of the apparatus of FIG. 5 illustrating the compression ring and the vertically opposed cooperating cam surfaces for capturing and compressing the ring as the cap and skirt are threaded progressively together.

FIGS. 5 and 6 illustrate alternate embodiment of the invention wherein the compression ring is compressed into gripping engagement with the chime by a pair of opposed contoured surfaces configured to move together to capture and compress the ring 63 as the cap advances onto the skirt. More specifically, this embodiment includes a cap 46 having an internally threaded peripheral rim 47, and an underside surface 48 that bears a depending annular projection 49 and sealing gasket 51. A generally annular skirt 52 is formed with exterior threads 53 configured to receive the threads 50 of the cap rim 47 such that the cap 46 can be advanced progressively onto the skirt 52 by threading the cap onto the skirt.

The skirt 52 is formed at its upper portion with a plurality of spaced radially extending tabs 59 each having a contoured surface 60. Although only 3 tabs are illustrated in FIG. 6, it will be understood that the tabs 59 extend about the entire inner periphery of the skirt 52.

The skirt 52 is configured to receive a cam ring 56 that is formed with a plurality of spaced downwardly extending tabs 65 each having a contoured sloped surface 67 that generally opposes and confronts the contoured surfaces of the skirt tabs 59. The tabs 65 of the cam ring 56 are configured and spaced to be received into the spaces between the tabs 59 of the skirt 52 such that the cam ring 56 can move toward and away from the skirt 52 with its tabs 65 interleaved with the tabs 59 of the skirt as best seen in FIG. 5. In this way, the opposed contoured surfaces of the tabs 59 and 65 cooperate to capture and compress the compression ring 63 toward and away from the can chime as the cam ring 56 moves toward and away from the skirt 52.

A notch 71 bearing an annular pad 72 is formed at the top of the tabs 65. The ring 63 slips into the notch 71 when it has been compressed tightly against the can chime to lock it in place as with the embodiment of FIG. 1.

The cap 46 is formed with a bearing surface 62 (FIG. 5) that bears against and urges the cam ring 56 toward the skirt 52 as the cap 46 and skirt 52 are threaded progressively together. Threading the cap onto the skirt, then, moves the contoured surfaces 60 and 67 of the tabs 59 and 65 toward one another, thus capturing and compressing the compression ring 63 radially into firm gripping engagement with the can 11 just below its upper peripheral chime. With the ring 63 in firm engagement with the can chime, it slips into the notch 71 formed in the cam ring 56 thus locking the ring 63 into position.

In using the embodiment of FIGS. 5 and 6 to seal a container, the cap and skirt are threaded apart a sufficient distance to allow the compression ring 63 to expand to a diameter slightly larger than that of the container chime 32. The assembly can then be slipped over the top of the container whereupon the cap is threaded progressively onto the skirt thus pressing the cam ring and skirt together to compress the ring 63 until it wedges firmly beneath the chime 32 to resist upward movement of the skirt 52. Further threading of the cap 46, then, moves the cap downwardly onto the can and firmly seats the gasket 51 within the chime recess 30 thus sealing off the end of the can against escape of internal gasses. Subsequently, the cap 46 can simply be unthreaded to permit the assembly to be removed from the container for dispensing the contents thereof.

The invention has been described above in terms of preferred embodiments and configurations. It will be obvious to those of skill in the art, however, that many additions, deletions, and modifications might well be made to the illustrated embodiments without departing from the spirit and scope of the invention as set forth in the claims. The illustrated embodiments should therefore not be considered limiting but rather only exemplary of principles of the present invention embodied therein.

I claim:

1. An apparatus for selectively capping and uncapping a container of the type having a container body and a container end with said apparatus comprising:

a skirt configured to extend at least partially about the body of the container adjacent the end thereof;

a cap configured to be received by said skirt with said cap at least partially spanning and covering the container end when said skirt is in position extending about the container body;

cooperative mating means on said cap and said skirt with said mating means being adapted to provide progressive movement of said cap onto said skirt upon appropriate manipulation of said cap relative to said skirt;

retaining means operatively associated with said cap and said skirt, said retaining means being configured to lock said skirt securely in position about the container body when moved into gripping engagement with the container;

means for moving said retaining means into gripping engagement with the container upon initial progressive movement of said cap onto said skirt to lock said skirt in position about the container;

means for maintaining said retaining means in gripping engagement with the container upon further progressive movement of said cap onto said skirt;

sealing means on said cap for engaging and sealing off the container end as said cap is moved progressively onto said skirt;

said retaining means comprising a diametrically compressible ring disposed within said apparatus and said means for moving said retaining means into gripping engagement with said container comprising means for compressing said compressible ring toward engagement with the container;

said means for compressing said ring comprising a cam formed in said cap with said cam being configured with a first contoured surface shaped and positioned to engage and compress said ring upon initial progressive movement of said cap onto said skirt; and said skirt having an upper surface, said first contoured surface of said cam being positioned to confront and move toward the upper surface of said skirt as said cap is moved progressively onto said skirt, said compressible ring being disposed between said skirt upper surface and said first contoured surface whereby the ring is engaged by and rides up the first contoured surface upon initial progressive movement of the cap onto the skirt to compress the ring diametrically into gripping engagement with the container.

2. An apparatus for selectively capping and uncapping a container of the type having a container body and a container end with said apparatus comprising:

a skirt configured to extend at least partially about the body of the container adjacent the end thereof;

a cap configured to be received by said skirt with said cap at least partially spanning and covering the container end when said skirt is in position extending about the container body;

cooperative mating means on said cap and said skirt with said mating means being adapted to provide progressive movement of said cap onto said skirt upon appropriate manipulation of said cap relative to said skirt;

retaining means operatively associated with said cap and said skirt, said retaining means being configured to lock said skirt securely in position about the container body when moved into gripping engagement with the container;

means for moving said retaining means into gripping engagement with the container upon initial progressive movement of said cap onto said skirt to lock said skirt in position about the container;

means for maintaining said retaining means in gripping engagement with the container upon further progressive movement of said cap onto said skirt;

sealing means on said cap for engaging and sealing off the container end as said cap is moved progressively onto said skirt;

said retaining means comprising a diametrically compressible ring disposed within said apparatus and said means for moving said retaining means into gripping engagement with said container comprising means for compressing said compressible ring toward engagement with the container;

said means for compressing said ring toward gripping engagement with said container comprising a cam ring disposed between said cap and said skirt with said cam ring being movable toward and away from said skirt upon progressive movement of said cap onto and off of said skirt, said cam ring being formed to define a first contoured surface positioned to oppose a surface of said skirt, said compressible ring being captured between said first contoured surface of said cam ring and said surface of said skirt as said cap is moved progressively onto said skirt to compress said compressible ring into engagement with said container.

3. An apparatus for selectively capping and uncapping a container as claimed in claim 2 and wherein said skirt is formed with a plurality of spaced radially arrayed tabs extending generally upwardly therefrom and wherein said cam ring is formed with a plurality of spaced radially arrayed tabs extending generally downwardly therefrom, said cam ring tabs being configured to be received into the spaces between said skirt tabs in interleaved fashion as said cam ring moves toward said skirt, said cam ring tabs and said skirt tabs being formed with contoured confronting surfaces configured to capture and compress said compressible ring into engagement with the container upon movement of said cam ring toward said skirt.

4. An apparatus for selectively capping and uncapping a container of the type having a container body and a container end with said apparatus comprising:

a skirt configured to extend at least partially about the body of the container adjacent the end thereof;

a cap configured to be received by said skirt with said cap at least partially spanning and covering the container end when said skirt is in position extending about the container body;

cooperative mating means on said cap and said skirt with said mating means being adapted to provide progressive movement of said cap onto said skirt upon appropriate manipulation of said cap relative to said skirt;

retaining means operatively associated with said cap and said skirt, said retaining means being configured to lock said skirt securely in position about the container body when moved into gripping engagement with the container;

means for moving said retaining means into gripping engagement with the container upon initial progressive movement of said cap onto said skirt to lock said skirt in position about the container;

means for maintaining said retaining means in gripping engagement with the container upon further progressive movement of said cap onto said skirt;

sealing means on said cap for engaging and sealing off the container end as said cap is moved progressively onto said skirt;

said sealing means comprising a generally annular gasket mounted within said cap with said gasket being constructed and configured to engage and seat against the end of the container as said cap is moved progressively onto said skirt to seal off at least a portion of the container end;

said gasket being sized to engage and seat about the peripheral portion of the container end;

said cap being formed with an interior depending annular projection and said annular gasket being mounted to and extending about the lower edge and sides of said projection.

5. An apparatus for selectively capping and uncapping a container of the type having a container body and a container end with said apparatus comprising:

a skirt configured to extend at least partially about the body of the container adjacent the end thereof;

a cap configured to be received by said skirt with said cap at least partially spanning and covering the container end when said skirt is in position extending about the container body;

cooperating mating means on said cap and said skirt with said mating means being adapted to provide progressive movement of said cap onto said skirt upon appropriate manipulation of said cap relative to said skirt;

retaining means operatively associated with said cap and said skirt, said retaining means being configured to lock said skirt securely in position about the container body when moved into gripping engagement with the container;

means for moving said retaining means into gripping engagement with the container upon initial progressive movement of said cap onto said skirt to lock said skirt in position about the container;

means for maintaining said retaining means in gripping engagement with the container upon further progressive movement of said cap onto said skirt;

sealing means on said cap for engaging and sealing off the container end as said cap is moved progressively onto said skirt;

said retaining means comprising a diametrically compressible ring disposed within said apparatus and said means for moving said retaining means into gripping engagement with said container comprising means for compressing said compressible ring toward engagement with the container;

said means for compressing said ring comprising a cam formed in said cap with said cam being configured with a first contoured surface shaped and positioned to engage and compress said ring upon initial progressive movement of said cap onto said skirt; and said means for maintaining said retaining means in gripping engagement with the container upon further progressive movement of said cap onto said skirt comprising a second contoured surface formed on said cam with said second contoured surface being configured to bear against said compressible ring with substantially constant force as said cap is moved further onto said skirt to maintain said ring in gripping engagement with the container.

6. An apparatus for selectively capping and uncapping a container of the type having a generally cylindrical container body and a container end, said apparatus comprising:

a skirt member configured to extend at least partially about the body of a container adjacent the end thereof;

a cap configured to be received by said skirt with said cap at least partially spanning and covering the container end when said skirt is in position extending about the container body;

cooperative mating means on said cap and said skirt with said mating means being adapted to provide progressive movement of said cap onto said skirt upon appropriate manipulation of said cap relative to said skirt;

confronting surfaces within said apparatus with said confronting surfaces being positioned at least partially to surround the container body adjacent its end when said apparatus is mounted on the container, said confronting surfaces being operatively associated with said cap and said skirt to move progressively toward each other as said cap is moved progressively onto said skirt;

a diametrically compressible retaining ring disposed within said apparatus captured between said confronting surfaces, said retaining ring being adapted to engage and grip the container to lock said apparatus securely thereabout when said retaining ring is compressed to a predetermined locking diameter;

at least one of said confronting surfaces being contoured to engage and compress said retaining means to its predetermined locking diameter upon initial progressive movement of said cap onto said skirt and to maintain said retaining ring at its predetermined locking diameter upon further progressive movement of said cap onto said skirt; and sealing means on said cap for engaging and sealing off the container end as said cap is moved progressively onto said skirt subsequent to compression of said retaining ring to its predetermined locking diameter, whereby the retaining ring is compressed to its locking diameter to engage the container and lock the apparatus thereabout upon initial progressive movement of the cap onto the skirt whereupon further progressive movement of the cap onto the skirt draws the sealing means into engagement with the container end to seal the container while the retaining ring is maintained at its predetermined locking diameter.

* * * * *